US005260754A

United States Patent [19]

Yano et al.

[11] Patent Number: 5,260,754

[45] Date of Patent: Nov. 9, 1993

[54] CLEANING UNIT FOR AN IMAGE FORMING APPARATUS

[75] Inventors: Hidetoshi Yano; Naomi Misago, both of Yokohama, Japan

[73] Assignee: Ricoh Company, Ltd., Tokyo, Japan

[21] Appl. No.: 858,717

[22] Filed: Mar. 27, 1992

[30] Foreign Application Priority Data

Mar. 27, 1991 [JP] Japan ..... 3-85869

[51] Int. Cl.[5] ..... G03G 21/00

[52] U.S. Cl. ..... 355/296; 15/256.5; 15/256.51; 118/652; 355/298; 355/301; 355/302

[58] Field of Search ..... 355/296-298, 355/301-303; 118/652; 15/256.5, 256.51

[56] References Cited

U.S. PATENT DOCUMENTS 3,989,372 11/1976 Davidge et al. ..... 355/298
4,021,113 5/1977 Zindikus et al. ..... 355/297
4,494,863 1/1985 Laing ..... 15/256.5 X
4,819,026 4/1989 Lange et al. ..... 118/652 X
4,870,466 9/1989 Iida et al. ..... 355/297
5,083,169 1/1992 Usui et al. ..... 355/296

OTHER PUBLICATIONS

*IBM Technical Disclosure Bulletin*, vol. 24, No. 1A, Jun. 1981, p. 424, Brannan, R. C., "Cleaning Brush Control", copy in 355/301.

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

A cleaning device incorporated in an image forming apparatus for removing a toner remaining on a photoconductive drum by a fur brush and collecting the removed toner by a collecting roller. The cleaning device selectively moves the fur brush into and out of contact with both of the photoconductive drum and collecting roller.

7 Claims, 3 Drawing Sheets

CLEANING UNIT FOR AN IMAGE FORMING APPARATUS

BACKGROUND OF THE INVENTION

The present invention relates to a cleaning unit incorporated in a copier, printer, facsimile apparatus or similar image forming apparatus for removing a toner deposited from a photoconductive element.

It is a common practice with a copier, for example, to electrostatically form a latent image on a photoconductive drum and cause a toner to deposite on the latent image to produce a toner image matching a document image. After the toner image has been transferred to a recording medium, e.g., paper sheet, part of the toner usually remains on the photoconductive drum and has to be removed before the next copying cycle begins. A cleaning device for removing the toner remaining on the drum may be implemented by a fur brush, as well known in the art. In this type of cleaning device, the fur brush is made of a conductive material and held in pressing contact with the photoconductive element to scrape off the toner remaining on the drum. The toner deposited on the fur brush is electrostatically transferred to a collecting roller, and then a collecting blade removes the toner from the collecting roller. The removed toner is conveyed to the outside of the cleaning device by a coil. The fur brush is provided with some elasticity since it has to rotate while thrusting into the drum and the collecting roller to a predetermined extent. However, when left stationary over a long period of time, the fur of the fur brush remains in the collapsed position and cannot return to the original position. In such a condition, the cleaning device fails to fully remove the toner or to collect it in an expected manner, resulting in the degradation of image quality. In light of this, the fur brush may be spaced apart from the drum or from the collecting roller while an image forming operation is not under way, as proposed in the past. With such a conventional implementation, however, it is impossible to completely free the fur brush from collapse since the fur brush remains in pressing contact with one of the drum and collecting roller, although it may be spaced apart from the other.

SUMMARY OF THE INVENTION

It is, therefore, an object of the present invention to provide a cleaning unit for an image forming apparatus which allows the fur of a fur brush to undergo a minimum of collapse to thereby eliminate the incomplete removal or collection of a toner.

A cleaning unit incorporated in an image forming apparatus for removing a toner remaining on a photoconductive element of the present invention comprises a conductive fur brush for scraping off the toner remaining on the photoconductive element, a collecting roller applied with a bias voltage for collecting the toner deposited on the fur brush, and a brush moving mechanism for moving the fur brush selectively into and out of contact with the photoconductive element and collecting roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
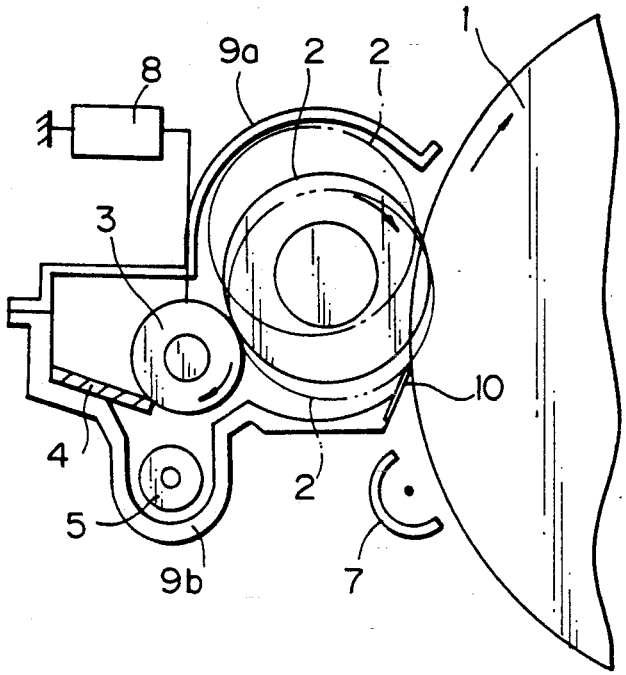
FIG. 1 is a sectional side elevation showing a cleaning unit embodying the present invention.
Figure 2:
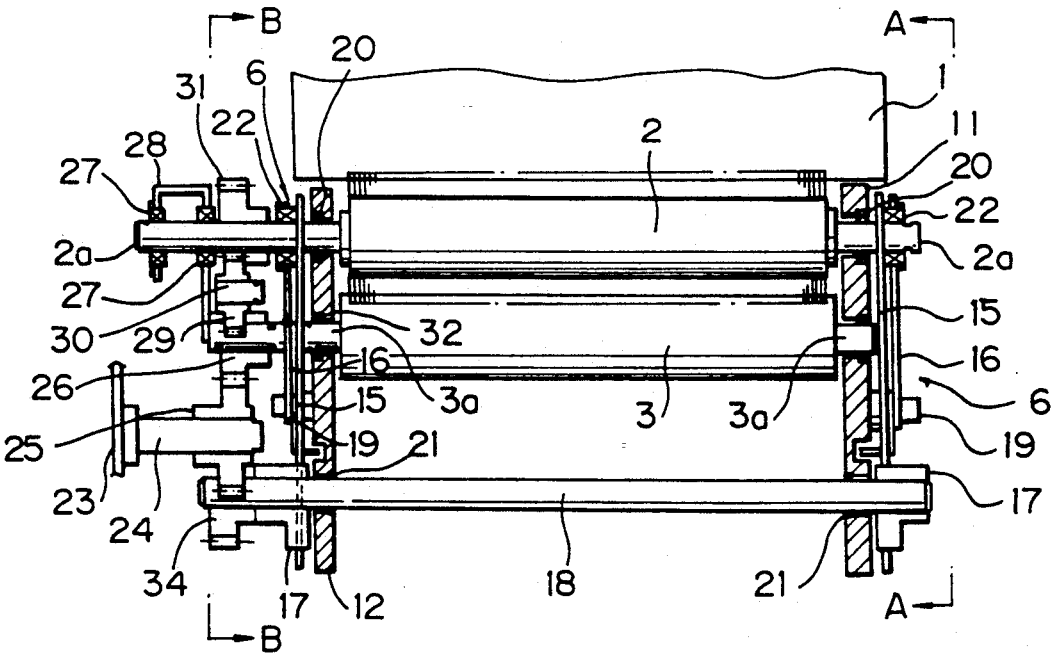
FIG. 2 is a plan view of the embodiment.

Referring to FIG. 1 of the drawings, a cleaning unit embodying the present invention is shown and includes a fur brush 2. The fur brush 2 has conductive filaments and is rotatably held in contact with a photoconductive element 1. The fur brush 2 catches a toner remaining on the drum 1 with the free end thereof. A collecting roller 3 is applied with a bias voltage opposite in polarity to the toner and scrapes off the toner from the fur brush 2 due to the potential difference between it and the fur brush 2. Further, a collecting blade 4 scapes off the toner from the collecting roller 3. The toner so removed from the collecting roller 3 is conveyed to the outside of the cleaning unit by a screw 5. FIG. 2 shows a brush moving mechanism 6 for moving the fur brush 6 to any one of three different positions, i.e., a first scraping position, a second scraping position, and a retracted position respectively indicated by a solid line, a dash-and-dots line, and a dash-and-dot line in FIG. 1. The first scraping position is a usual position for scraping off the remaining toner from the drum 1. In the second scraping position, the fur brush 2 thrusts deeper into the drum 1 than in the first scraping position. In the retracted position, the fur brush 2 is spaced apart from both of the drum 1 and collecting roller 3. If desired, the toner removed from the collecting roller 3 by the collecting blade 4 may be accumulated within the cleaning device. In FIG. 1, there are also shown a precleaning charger 7, a power source 8 for driving the collecting roller 3, an upper casing 9*a*, a lower casing 9*b*, and a lower seal 10.

Figure 3:
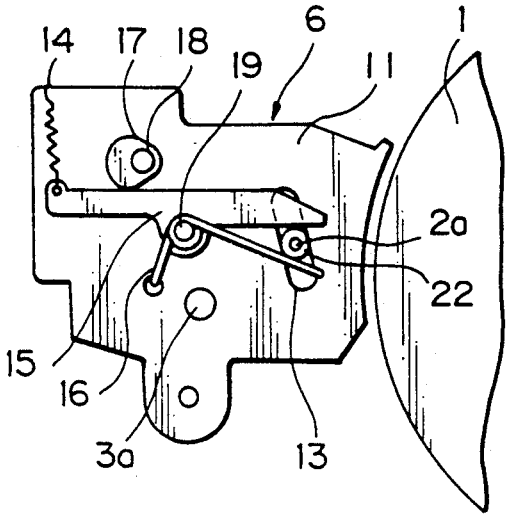
FIG. 3 is a view as seen in a direction A—A of FIG. 2.

As shown in FIGS. 2 and 3, the shaft 2*a* of the fur brush 2 and the shaft 3*a* of the collecting roller 3 are journalled to opposite side plates 11 and 12. The brush moving mechanism 6 is arranged at the outside of both side plates 11 and 12 in a symmetrical configuration. Specifically, the side plates 11 and 12 (only 11 is shown in FIG. 3) are each formed with an elongate slot 13. The shaft 2*a* of the fur brush 2 is received in the slot 13 of each side plate through a ball bearing 20, so that the brush 2 may be movable between the second scraping position and the retracted position. A stub or cam lever shaft 19 is studded on an intermediate portion of each side plate 11 or 12. A cam lever 15 is rotatably supported by the cam lever shaft 19 at an intermediate portion thereof. The cam lever 15 abuts against the upper periphery of the shaft 2*a* via the ball bearing 22 at one end thereof. A spring 14 is anchored at one end thereof to the other end of the cam lever 15 to constantly bias the cam lever 15 upward. In this configuration, the shaft 2*a* of the fur brush 2 is constantly biased toward the second scraping position. A coil spring 16 is retained by the lower periphery of the shaft 2*a* via the ball bearing 22 at one end thereof and anchored to a suitable portion of associated one of the side plates 11 and 12 at the other end. The coiled portion of the coil spring 16 is coupled over the cam lever 19. The coil spring 16, therefore, biases the shaft 2a of the fur brush 2 upward toward the retracted position. A cam 17 is disposed above the upper edge of the end portion of the cam lever 15 remote from the shaft 2a and is so configured as to move the cam lever 15 in three different angular positions stepwise. The cam 17 is affixed to a cam shaft 18 which is journalled to the side plates 11 and 12 by slide bearings 21. As the cam shaft 18 is rotated, the cam 17 is brought to any one of three different angular positions stepwise. The cam spring 14 exerts a greater force than the coil spring 16.

Figure 4:
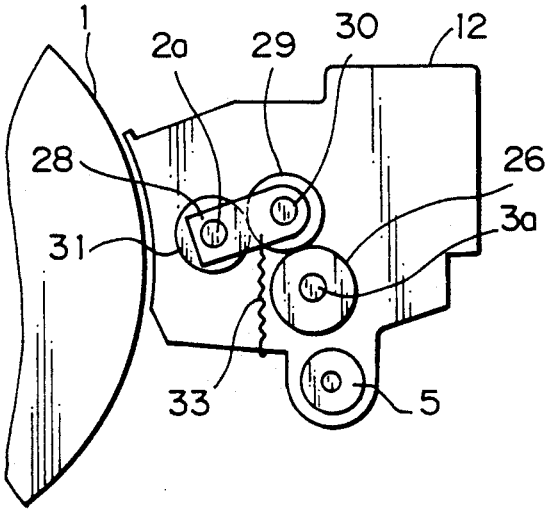
FIG. 4 is a view as seen in a direction B—B of FIG. 2.

The fur brush 2 is selectively rotated to any one of the three angular positions as stated above by a drive mechanism shown in FIGS. 2 and 4. As shown, the drive mechanism includes an input gear 25 mounted on an input shaft 24 which is in turn supported by a side plate 23 forming part of the cleaning unit. A gear 26 is mounted on the shaft 3a of the collecting roller 3 and held in mesh with the input gear 25. A bracket 28 is rotatably mounted on the shaft 2a of the fur brush 2 by a ball bearing 27. An idle gear 29 is supported by the bracket 28 via an idler shaft 30 and held in mesh with the gear 26. Further, the idle gear 29 is held in mesh with a gear 31 mounted on the shaft 2a. In FIG. 2, the reference numerals 34 and 32 designate a cam gear and a ball bearing, respectively. In FIG. 4, the reference numeral 33 designates an idler spring exerting an downward force.

Figure 5:
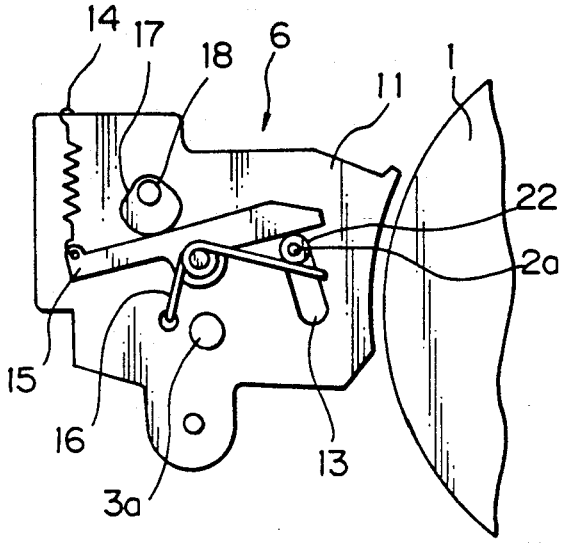
FIGS. 5 and 6 are views similar to FIG. 3, each showing the embodiment in a particular condition.
Figure 6:
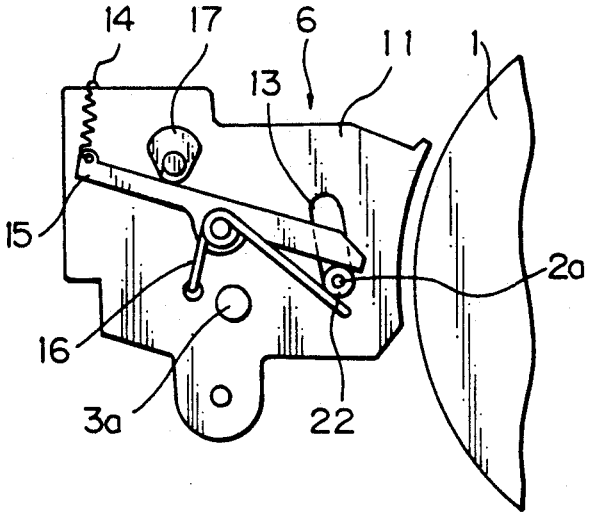

To remove the toner remaining on the drum 1, the fur brush 2 is brought to the first scraping position indicated by a solid line in FIG. 1. In this position, the fur brush 2 is rotatable while thrusting into both of the drum 1 and collecting roller 3 by a predetermined amount (about 1.5 millimeters). Should the fur brush 2 be left stationary over a long period of time, it would lose elasticity to give rise to the previously discussed problem. In the illustrative embodiment, the cam 17 and, therefore, the cam lever 15 is moved from the position of FIG. 3 to the position of FIG. 5 upon the elapse of a predetermined period of time (several seconds) after the fur brush 2 has been positioned in the first scraping position or when the machine is brought to an OFF state. In the position of FIG. 5, i.e., the retracted position, the fur brush 2 is spaced apart from both of the drum 1 and collecting roller 3. As the fur of the fur brush 2 sequentially lies down due to aging, it also degrades the image quality. In such a condition, the cam 17 is rotated to move the cam lever 15 to the position shown in FIG. 6, i.e., the second scraping position. In the second scraping position, the fur brush 2 thrusts deeper into the drum 1 than in the first scraping position by an amount corresponding to the collapse of the fur (possibly about 0.5 millimeter) and, therefore, uniformly contacts the drum 1 to insure desirable images. Such a collapse of the fur of the fur brush 2 may be detected in terms of the count of a counter or similar detecting means responsive to the number of copies produced (e.g. about 200K in the case of a copy counter).

While an image forming operation is not under way, the cam 17 remains in the position of FIG. 5 which is angularly spaced apart from the position of FIG. 3 by 270 degrees in the clockwise direction, by a drive (e.g. spring clutch) from the body, not shown. When the machine is held in an OFF state, a home position sensing means, not shown, causes the fur brush 2 to remain in the position of FIG. 5. To move the fur brush 2 to the second scraping position, the cam 17 is rotated 90 degrees clockwise from the reference position of FIG. 3 to the position of FIG. 6. The displacement of the fur brush 2 has to be accompanied by the displacement of the idle gear 29. At this instant, the idle gear 9 and the gear 26 mounted on the roller shaft 3a are surely held in mesh since the bracket 28 supporting the idle gear 29 is constantly biased downward by the idler spring 33.

In summary, it will be seen that the present invention provides a cleaning unit which allows a fur brush to undergo a minimum of collapse by spacing it apart from a photoconductive element and a collecting roller by a brush moving mechanism. The fur brush is capable of thrusting into the drum in a plurality of amounts stepwise. Hence, after an image forming cycle has been repeated a predetermined number of times, the fur brush can thrust into the drum in a greater amount to eliminate incomplete removal or collection of a toner due to the collapse of the fur brush.

Various modifications will become possible for those skilled in the art after receiving the teachings of the present disclosure without departing from the scope thereof.

What is claimed is:

1. A cleaning unit incorporated in an image forming apparatus for removing a toner remaining on a photoconductive element, comprising:

a conductive fur brush for scraping off the toner remaining on said photoconductive element;

a collecting roller applied with a bias voltage for collecting the toner deposited on said fur brush; and brush moving means for moving said fur brush selectively into and out of contact with said photoconductive element and said collecting roller wherein said fur brush is mounted upon a shaft, and wherein a portion of said shaft is received in a guide, said guide defining a path of movement of said fur brush as said fur brush is moved by said brush moving means.

2. A cleaning unit as set forth in claim 1, wherein said brush moving means further includes means for moving said fur brush into at least two contact positions in which said fur brush is in contact with both said photoconductive element and said collecting roller.

3. The cleaning unit of claim 2, wherein said brush moving means moves said fur brush from one of said at least two contact positions to a second of said at least two contact positions after an image forming cycle has been repeated a predetermined number of times.

4. A cleaning unit incorporated in an image forming apparatus for removing toner remaining on a photoconductive element comprising:

a conductive fur brush for scraping off toner remaining on said photoconductive element;

a collecting roller applied with a bias voltage for collecting toner deposited on said fur brush; and mounting means for selectively mounting the fur brush at a plurality of positions, and wherein in at least one of said plurality of positions said conductive brush is out of contact with both of said photoconductive element and said collecting roller thereby reducing deformation of said fur brush when said fur brush is not operating to scrape off toner remaining on said photoconductive element, wherein said fur brush is mounted upon a shaft, and wherein said mounting means includes a plate having a slot formed therein, and wherein said slot receives a portion of said shaft upon which the fur brush is mounted such that the shaft is movable along said slot as the fur brush moves between the plurality of positions, the slot thereby defining a path of movement of said fur brush, and wherein the path of movement defined by the slot includes a direction in which the fur brush is moving away from both said photoconductive element and an axis of said collecting roller.

5. The cleaning unit of claim 4, wherein said mounting means includes a cam actuated positioning device.

6. The cleaning unit of claim 5, wherein said cam actuated positioning device contacts the shaft upon which the fur brush is mounted and moves the shaft along said slot, thereby moving said fur brush to said plurality of positions, and wherein said cam actuated positioning device moves the fur brush to at least three positions, wherein in a first position, said shaft is sufficiently spaced from both said collecting roller and said photoconductive element such that said fur brush is out of contact with both said collecting roller and said photoconductive element, wherein at a second position, the shaft of the fur brush is closer to both of said shaft of said collecting roller and said photoconductive element as compared with said first position, and wherein in a third position, said shaft of said fur brush is closer to both said collecting roller and said photoconductive element as compared with said second position.

7. A cleaning unit incorporated in an image forming apparatus for removing a toner on a photoconductive element comprising:

a rotary brush for scraping off toner remaining on said photoconductive element;

a collecting roller mounted upon a shaft for collecting toner deposited on said brush; and a movably mounted shaft upon which said rotary brush is mounted, said shaft movable among at least three positions, wherein in a first position, said shaft is sufficiently spaced from said photoconductive element and said collecting roller such that said brush is out of contact with both said collecting roller and said photoconductive element, in a second position, said fur brush is located closer to both of said collecting roller and said photoconductive element as compared with said first position, and wherein said brush contacts both said collecting roller and said photoconductive element in said second position at least when said brush is new, and further wherein in a third position, said brush is located closer to both of said collecting roller and said photoconductive element as compared with said second position;

wherein when said brush is new, said brush can be moved between said second position in which said brush contacts both of said collecting roller and said photoconductive element and said first position in which said brush is out of contact with both of said photoconductive element and said collecting roller such that wear is reduced by moving the brush to the first position thereby reducing contact, and wear is also reduced by positioning said second position such that excessive contact does not exist between said brush and said collecting roller and photoconductive element when said brush is new, and wherein after a period of use, said brush can be moved between said third position and said first position, such that wear is reduced when said brush is in said first position, and wear is reduced when said brush is in said first position, and wear is accommodated for in said third position, such that the brush is maintained on contact with both said photoconductive element and said collecting roller.

* * * * *